United States Patent [19]

Durazzani et al.

[11] Patent Number: 4,903,508

[45] Date of Patent: Feb. 27, 1990

[54] CLOTHES WASHING MACHINE CONVERTIBLE TO COMBINED CLOTHES WASHING AND DRYING MACHINE

[75] Inventors: Piero Durazzani, Pordenone; Giuseppe Carniel, Treviso, both of Italy

[73] Assignee: Industrie Zanussi S.p.A., Pordenone, Italy

[21] Appl. No.: 346,938

[22] Filed: May 3, 1989

[30] Foreign Application Priority Data

May 4, 1988 [IT] Italy ..... 45722 A/88

[51] Int. Cl.[4] ..... D06F 25/00; D06F 37/28

[52] U.S. Cl. ..... 68/4; 68/20

[58] Field of Search ..... 68/4, 19.2, 20

[56] References Cited

U.S. PATENT DOCUMENTS 2,328,256 8/1943 Breckenridge ..... 68/20 X
2,782,622 2/1957 Candor ..... 68/20 X
3,102,406 9/1963 Jakobsson ..... 68/20 X
4,765,162 8/1988 Ouellette ..... 68/20

FOREIGN PATENT DOCUMENTS 311167 1/1956 Switzerland ..... 68/4

*Primary Examiner*—Philip R. Coe
*Attorney, Agent, or Firm*—Wenderoth, Lind & Ponack

[57] ABSTRACT

A clothes washing machine is convertible to a clothes drying or a combined clothes washing and drying machine and includes a washing tub made of plastic material and a rotating inner drum housed in the tub and capable of being driven at the various revolving speeds required for both washing and drying cycles. The tub is provided with an upper opening which can be closed by exchangeable or interchangeable closing elements including, when the machine is being used as a dryer, an arched closing element provided with a number of electrical heating elements and an upper port capable of being connected with an exhaust manifold of the machine via a hot air circulating conduit.

7 Claims, 2 Drawing Sheets

CLOTHES WASHING MACHINE CONVERTIBLE TO COMBINED CLOTHES WASHING AND DRYING MACHINE

BACKGROUND OF THE INVENTION

The present invention relates to a clothes washing machine which is so designed as to allow it to be most quickly and simply converted into a combined clothes washing and drying machine.

Current clothes washing machines are specifically designed to perform washing programs required for different types of fabrics and washloads. Most of these programs include prewash, primary wash and several rinse cycles, possibly followed by a final spin extraction operation in order to remove the greatest possible quantity of wash and rinse water from the washload before putting it to dry.

In particular, drying can take place in special drying machines or in combined clothes washing and drying machines of traditional design, using the most appropriate drying programs available according to the type of fabrics to be handled.

As a result, the operation of washing and drying clothes makes it necessary to have either two separate machines for such purposes, i.e. a washing machine and a drying machine, or a single combined washing and drying machine. Known combined machines however have proven to be quite complicated in both design and construction.

SUMMARY OF THE INVENTION

It is the object of the present invention to overcome all such drawbacks and limitations of known clothes washing and drying machines by solely employing a pure washing machine that is designed and constructed in a manner to allow it to be most readily converted into a drying machine by simple means and procedure.

This and further objects are achieved according to the present invention by the provision of a clothes washing machine including a washing tub of plastic material, a rotatable drum housed in the tub and driven by at least one electric motor of traditional type, and an exhaust manifold connected to a lower part of the tub and to a pump for draining wash liquor from the tub. The tub is provided with an opening, preferably defined at the upper part of the tub, that can be sealingly closed by means of exchangeable or interchangeable closing elements, each enabling respective traditional washing or drying cycles to be performed in the machine. The closing element for the drying cycles is provided with a plurality of heating elements and at least one hole, to be connected with one end of a separate conduit provided with suction means to establish hot air circulation through the drum and tub, the other end of such conduit being connectable with the exhaust manifold.

BRIEF DESCRIPTION OF THE DRAWINGS

The characteristics of the invention will become more clearly apparent from the following description, given by way of non-limiting example and with reference to the accompanying drawings, wherein.

DETAILED DESCRIPTION OF THE INVENTION

Figure 1:
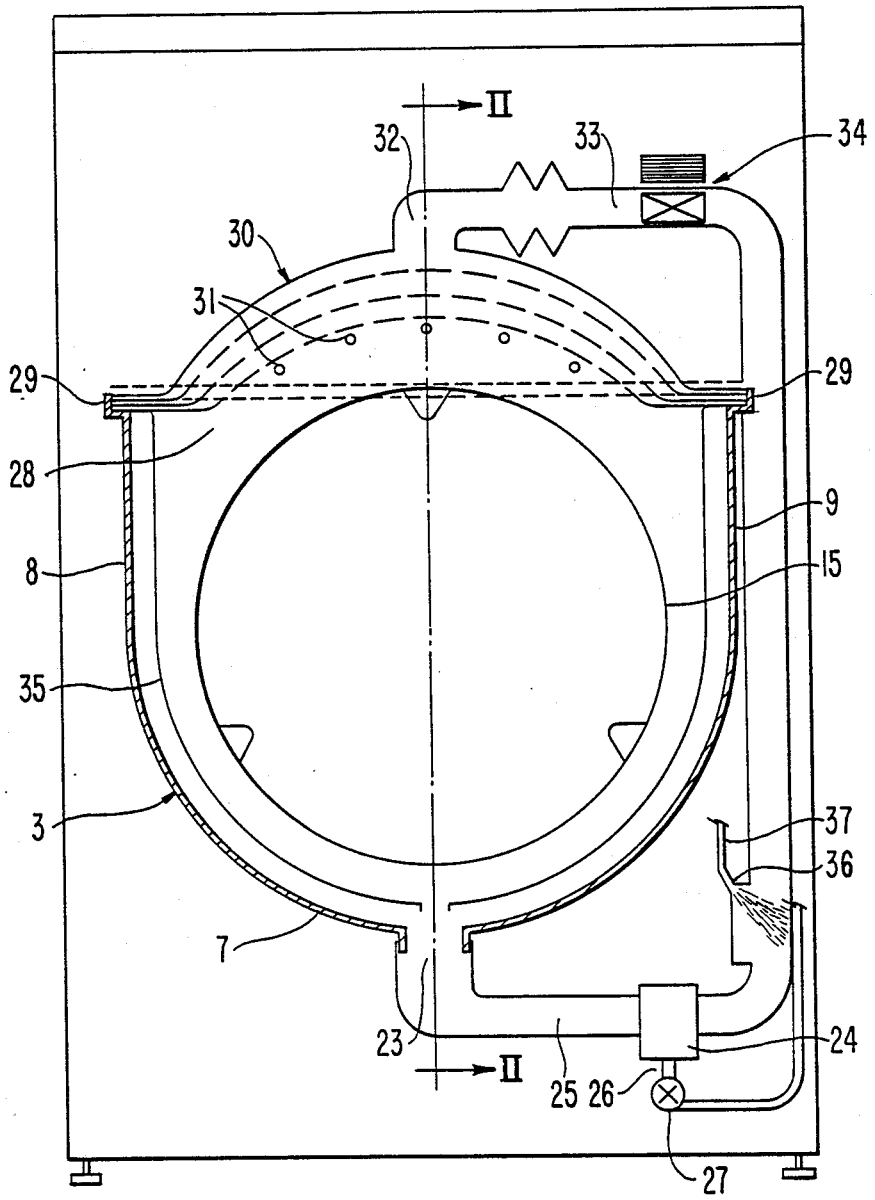
FIG. 1 is a schematic cut-away front view of a washing machine according to the invention.
Figure 2:
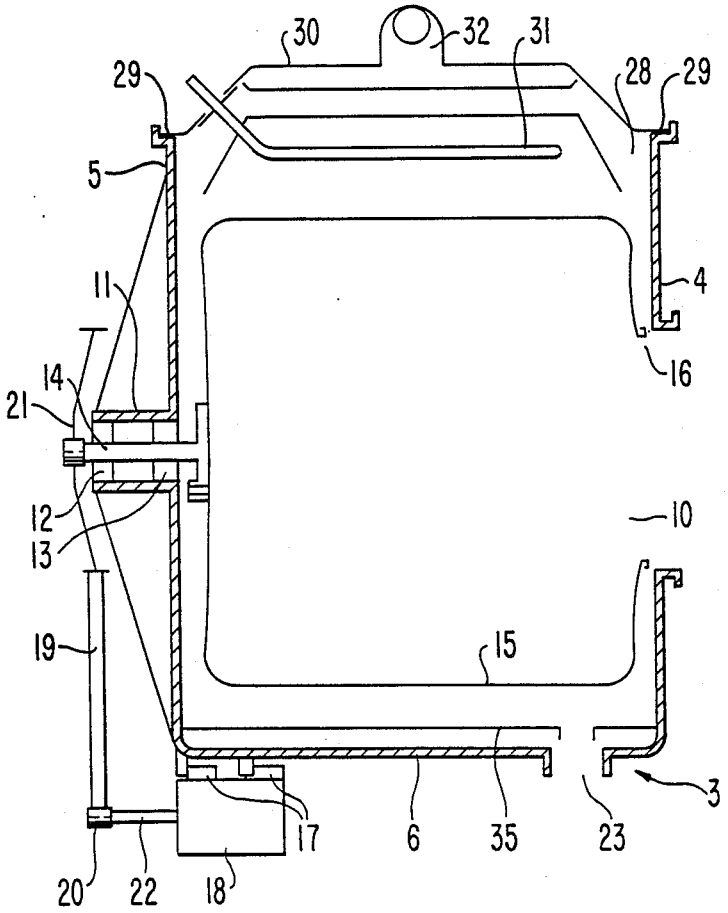
FIG. 2 is a side view taken along section line II—II in FIG. 1.

With reference to the drawings, the clothes washing machine according to the invention substantially includes a washing tub 3, which in a preferred embodiment is made as a single plastic molding shaped to form two end walls 4 and 5, i.e. front and rear walls, respectively, and a peripheral or side wall 6 which is integrally joined together with end walls 4, 5 and which includes a semicircular lower portion 7 and two straight vertical portions 8 and 9 integral together with such semicircular bottom portion.

In particular, end walls 4 and 5 are respectively provided with a circular access opening 10 and a hub 11 protruding longitudinally and capable of housing bearings 12 and 13 to support a driving shaft 14 of a drum 15 of the washing machine. Drum 15 is housed within tub 3 and is provided with a circular access opening 16 aligned and coinciding with the access opening 10 of the tub 3.

Tub 3 further is provided with brackets 17 around peripheral or side wall 6 to act as a support for an electric motor 18 used to drive the drum 15. Drive motor 18 is of a size to cause drum 15 to rotate, via a driving belt 19 mounted on respective pulleys 20 and 21 of a shaft 22 of the motor and driving shaft 14 of the drum, at revolving speeds necessary both for various wash and spin cycles of washing machines and for drying cycles of drying or combined washing and drying machines.

The peripheral wall 6 of the tub is further provided with a lower drain hole 23 which is connected with an exhaust manifold 24 via a conduit 25. Exhaust manifold 24 is formed as a single plastic molding provided with a pipe union 26 for connection with a drain pump 27, and also is designed to allow for the possible connection of a further conduit, to be described hereinafter.

Finally, tub 15 is provided with an opening 28 which in a preferred embodiment is defined at the upper part thereof and is capable of being tightly and sealingly closed, with the interposition of at least one sealing gasket 29 which is so shaped as to rest around the entire peripheral edge of opening 28, by at least one interchangeable closing element 30 so sized and shaped as to perfectly fit all around such peripheral edge of the opening 28.

In particular, closing element 30 can consist of a straight profiled sheet-metal member, shown by dashed lines in FIG. 1, which is fixed against sealing gasket 29 all around the peripheral edge of opening 28, in the case that the machine is being used solely as a washing machine. When fitted in this way, the upper part of the tub is closed by such straight sheet-metal member, so that the machine is able to perform all wash and spin cycles in a traditional manner, while the motor 18 is set to drive the drum at the corresponding wash and spin revolving speeds. In such a case, therefore, the wash liquor can be drained from the machine, at the end of the wash and rinse cycles, through the drain hole 23, the conduit 25, and the drain pump 27.

Also, such straight closing element can be replaced by another type of closing element 30, shown by continuous lines in FIG. 1, having the same peripheral size, but with a different, preferably arched, shape. This closing element is made of metal and is provided with a number of electric heating elements 31 which are fastened against its inner arched surface, as well as with an upper through hole 32 which is fitted for connection to one end of a separate conduit 33 including a blower 34. The other end of conduit 34 is arranged for connection with the exhaust manifold 24. This latter connection is to be made by inserting the end of the conduit 33 through a suitable hole (not shown) in the manifold 24. Such hole is obtained by breaking off a thin diaphragm in the manifold 24. In this way, due to the possibility of using such arched closing element connected with the conduit 33, the washing machine can be most readily and simply converted into a clothes drying machine or to a combined washing and drying machine, while at the same time setting the electric motor 18 of the machine so that it will drive the drum at the revolving speeds necessary for performing clothes drying cycles. As a matter of fact, the provision of the conduit 33 and the blower 34 enables a closed-loop forced air circulation to be established through conduit 33, the heating elements 31, the clothes in the drum 15 and the conduit 25, while heating up of such air and, as a consequence, the clothes in the drum 15.

In order to prevent the heat radiating from heating elements 31, and reflected by the metal surface of the closing element 30 against the inner surface of the plastic tub 3, from damaging the material of tub 3, a metal shield or screen 35 is fastened at an upper portion thereof to the peripheral area section of the closing element and at a lower portion thereof to the inner surface of the tub. Specifically, screen 35 is interposed between such inner surface of the tub and the rotatable drum 15. The mounting of screen 35 is shown schematically only, and one skilled in the art would understand how to achieve such mounting to enable protection of the tub.

In a particularly advantageous arrangement, the conduit 33 is further shaped so that it can accommodate a spray nozzle 36, which can be connected with the water supply of the machine through a tubing 37 and is therefore capable of condensing vapors resulting from the drying operation. The resulting condensate will then be exhausted through the drain pump 27.

Although specific features of the invention have been described and illustrated herein, it is to be understood that various changes and modifications may be made to the specifically described and illustrated features without departing from the scope of the invention.

We claim:

1. In a clothes washing machine also employable as a clothes drying machine and including a washing tub of plastic material, a rotatable drum housed in said tub and driven by at least one electric motor, an exhaust manifold connectable to said tub, and a pump for draining wash liquor from said tub through said exhaust manifold, the improvement comprising:

said tub having an opening;

a first interchangeable closing element for sealingly closing said opening when said machine is used to perform clothes washing operations;

a second interchangeable closing element for closing said opening when said machine is used to perform clothes drying operations, said second closing element including at least one heating element and having at least one hole; and a conduit connectable at one end thereof to said hole and at the other end thereof to said exhaust manifold, said conduit being provided with suction means for creating circulation of air, heated by such heating element, through said machine during the drying operations.

2. The improvement claimed in claim 1, wherein said second closing element has an arched shape and includes a peripheral section, and further comprising a heat screen fastened to said peripheral section and positioned between said drum and the inner surface of said tub.

3. The improvement claimed in claim 2, wherein said heat screen is formed of metal.

4. The improvement claimed in claim 2, wherein said heat screen also is fastened to said inner surface of said tub.

5. The improvement claimed in claim 1, wherein said opening is in the top of said tub.

6. The improvement claimed in claim 1, wherein said first closing element has a substantially flat configuration.

7. The improvement claimed in claim 6, wherein said first closing element is free of openings.

* * * * *